United States Patent [19]

Genessi

[11] 4,115,485

[45] Sep. 19, 1978

[54] LINT INTERCEPTOR

[76] Inventor: Richard J. Genessi, 2434 Rivera St., San Francisco, Calif. 94116

[21] Appl. No.: 810,387

[22] Filed: Jun. 27, 1977

[51] Int. Cl.[2] ..... B01F 3/04

[52] U.S. Cl. ..... 261/119 R; 55/244; 55/260; 55/413

[58] Field of Search ..... 261/119 R; 55/242, 244, 55/260, 413, 414, 466; 34/79

[56] References Cited

U.S. PATENT DOCUMENTS

| | | | |
|---|---|---|---|
| 1,750,800 | 3/1930 | Gould | 55/466 |
| 2,527,531 | 10/1950 | Cates, Jr. | 261/119 R X |
| 2,777,536 | 1/1957 | Thomas et al. | 261/119 R X |
| 2,816,621 | 12/1957 | Weaver | 261/119 R X |
| 2,818,135 | 12/1957 | White | 55/242 X |
| 3,738,627 | 6/1973 | Scotchmur | 261/119 R |
| 4,011,802 | 3/1977 | Molitor et al. | 55/244 X |

*Primary Examiner*—Richard L. Chiesa

*Attorney, Agent, or Firm*—Clarence A. O'Brien; Harvey B. Jacobson

[57] ABSTRACT

A lint interceptor having a housing provided with a cavity forming a liquid reservoir and associated traps. A fitting is associated with the housing for connecting a hose from a clothes dryer, and the like, to the housing, while at least one aperture is provided adjacent the fitting for permitting a fluid carrying the lint into the housing to escape therefrom. A baffle is disposed within the housing in order to form a flow path for the fluid between at least one opening associated with the fitting and the one or more apertures, and to direct the fluid, and its entrained lint, over a body of liquid disposed in the liquid reservoir formed within the housing.

1 Claim, 4 Drawing Figures

LINT INTERCEPTOR

BACKGROUND OF THE INVENTION

1. Field of the Invention

This invention relates generally to a lint interceptor, and particularly to a lint interceptor for separating lint from a stream of air emanating from a clothes dryer, and the like.

2. Description of the Prior Art

A problem commonly encountered with the use of the conventional, and commonplace, clothes dryers, and the like, is the disposal of lint separated from the clothing during the drying process. Frequently, the exhaust gases from the dryer, together with lint, dust particles, and the like, are merely dispersed into the atmosphere. While devices are known generally for separating the lint and dust particles from the stream of exhaust air, these known devices often cause back pressure that may be harmful to the mechanical parts of the appliance with which the separator is associated. Further, many of these known devices require a constant water level which has to be maintained by some means which adds to the complexity and maintenance of the system. Specifically, this constant water level requirement necessarily entrails piping from a potable water source, and if this piping is not installed correctly, it may tend to contribute to contamination of the water. In addition, these known devices may additionally contribute to the back pressure on the appliance by relying on screens, filters, and the like, which tend to clog.

U.S. Pat. No. 2,527,531, issued Oct. 31, 1950, to M. L. Cates, Jr., discloses a lint trap having top and bottom portions with side walls in-between, and including a protruding delivery pipe through the top which is extended at a given point above a water level whereby air, smoke, dust, lint, and hot air become trapped in a sealed unit. Further, the device disclosed in U.S. Pat. No. 2,527,531, requires a constant water level which must be maintained by reservoir added to the trap, usually by piping extending from a potable water source.

U.S. Pat. Nos. 2,818,135, issued Dec., 1957, to A. W. White, and 1,750,800, issued Mar., 1930, to S. R. Gould, also disclose lint trapping devices, with patent No. 2,818,135 disclosing a device which comprises a mass of baffles, ducts, pipes, and a two-part system arranged for washing contaminated fluids. The device disclosed in U.S. Pat. No. 1,750,800 is in the form of a vacuum cleaner operated by a combustion engine.

SUMMARY OF THE INVENTION

It is an object of the present invention to provide a lint interceptor that allows free passage of air or other fluid from a dryer, and the like, thus eliminating back pressure to the dryer.

It is another object of the present invention to provide a lint interceptor that is independent of a predetermined water level.

It is yet another object of the present invention to provide a lint interceptor free of filters, screens, and the like, thus eliminating overheating of the associated appliance due to increased back pressure caused by clogging of such screens and filters.

It is yet another object of the present invention to provide a lint interceptor which directs the contaminated fluid along a predetermined optimum path to assure efficient washing of the fluid.

These and other objects are achieved according to the present invention by providing a lint interceptor having: a housing provided with a cavity forming a liquid reservoir; a fitting provided on the housing for connecting a hose to the housing and placing the hose in communication with the cavity provided in the housing; at least one aperture provided in the housing adjacent the fitting for permitting the escape from the housing of a fluid ejected into the cavity of the housing at the fitting; and an improvement in the form of a baffle arranged within the housing for directing the flow of the fluid through the housing from the fitting to the aperture.

The baffle is arranged within the housing above the cavity thereof, such that one or more passages formed by the baffle are in communication with the fitting, cavity, and aperture for forming the desired flow path through the housing. The baffle also includes one or more curved fenders arranged directly beneath associated apertures and disposed extending into the cavity above an upper level of the liquid reservoir for directing fluid flow from the passages, across the upper level of the liquid reservoir, and to bores formed in the baffle and associated with respective apertures.

The lower surface of the baffle can be curved as appropriate to cooperate with the fenders and assure optimum flow of the contaminated fluid into the cavity of the housing and over the surface of the liquid in the reservoir formed at the bottom of the housing cavity.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a partly schematic, perspective view showing a lint interceptor according to the present invention connected to a conventional clothes dryer, and the like.

DESCRIPTION OF THE PREFERRED EMBODIMENTS

Figure 1:
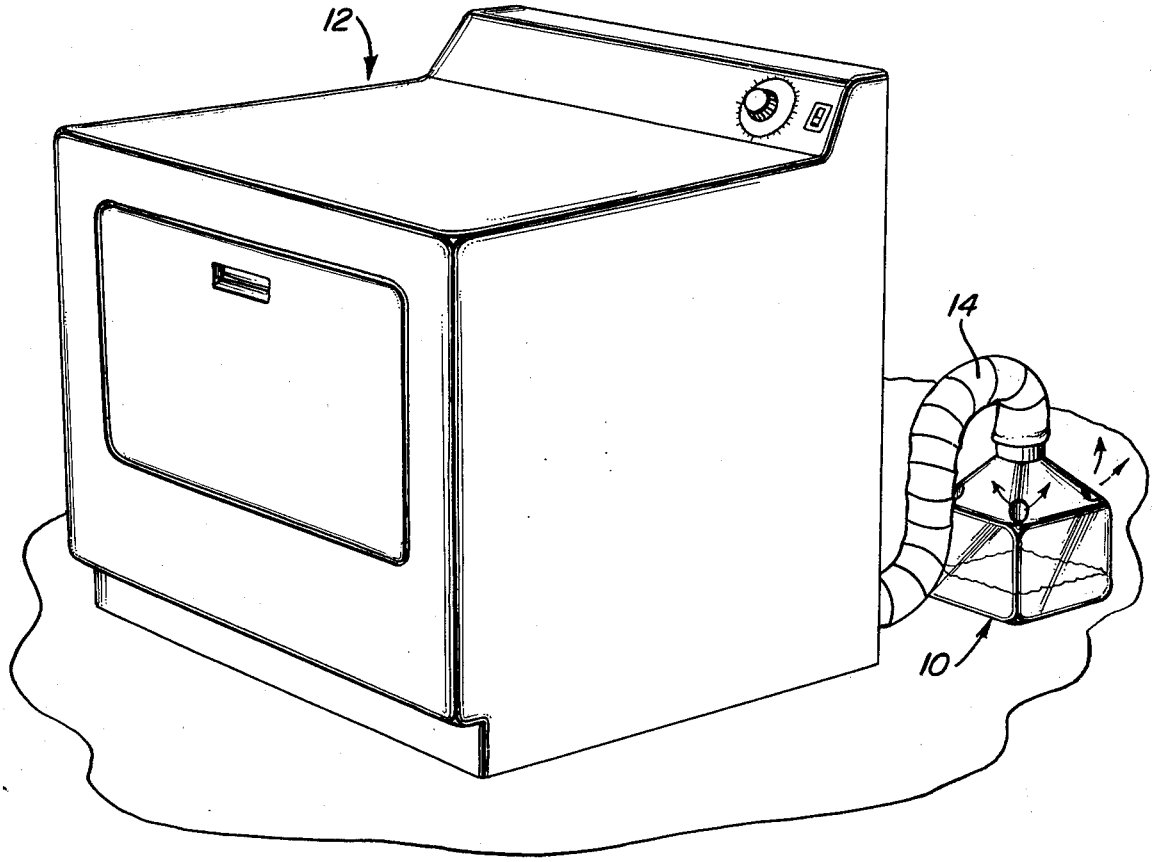

Referring now more particularly to FIG. 1 of the drawings, a lint interceptor 10 according to the present invention is shown attached to a conventional clothes dryer 12 as by a length of standard hose 14. It is to be understood that although lint interceptor 10 is shown as having a substantially rectangular, or cubical, lower portion and a frusto-conical top portion, the outer casing of a lint interceptor according to the present invention can assume any shape or form, with the important feature of the invention being the manner in which the traps and openings are placed on the outer casing so as to receive lint and to be able to discharge nothing but clean air, and the like.

Figure 2:
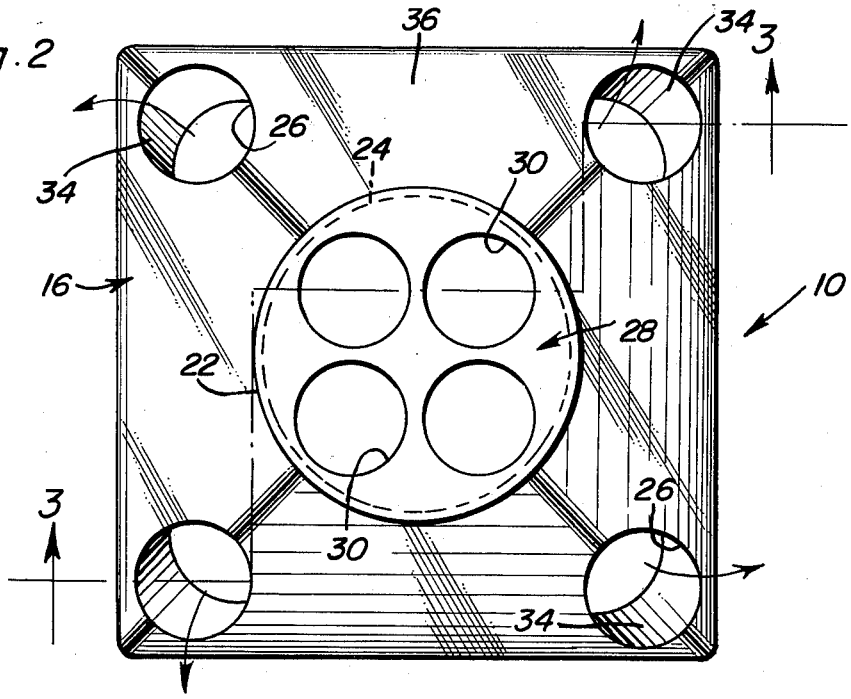
FIG. 2 is a top plan view showing the lint interceptor seen in FIG. 1, but with the hose removed.
Figure 3:
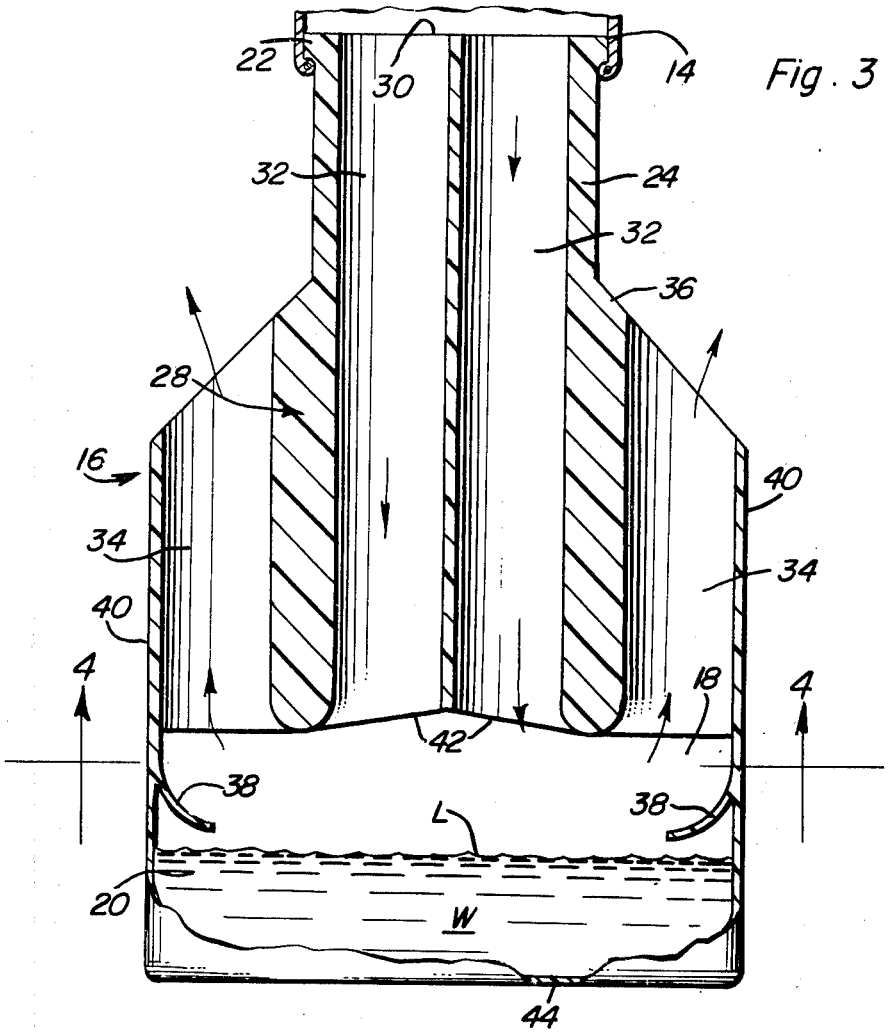
FIG. 3 is a fragmentary, sectional view taken generally along the line 3—3 of FIG. 2.
Figure 4:
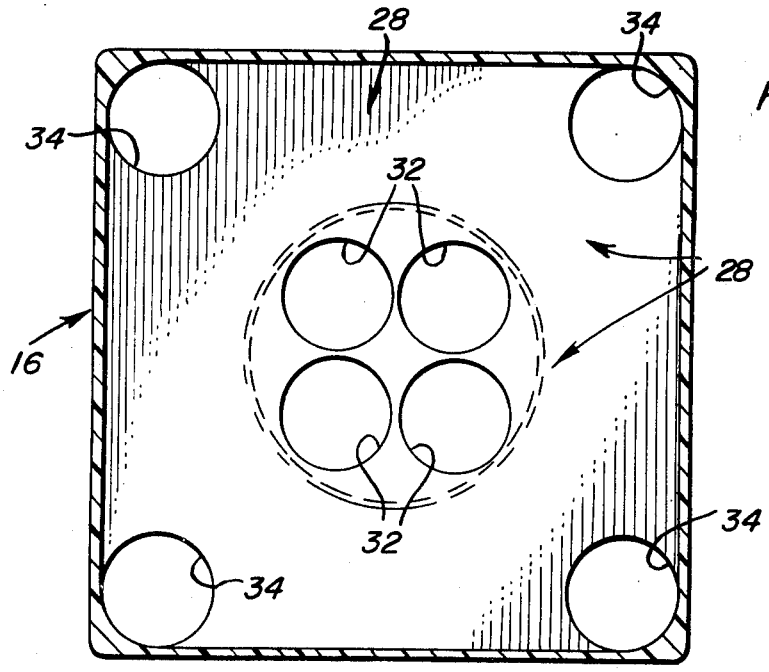
FIG. 4 is a sectional view taken generally along the line 4—4 of FIG. 3.

Referring now more particularly to FIGS. 2 through 4 of the drawings, lint interceptor 10 includes a housing 16 provided with a cavity 18 forming a liquid reservoir 20 at the bottom or lower portion of housing 16. A fitting in the form of the annular flange 22 is provided on the uppermost portion of a vertically extending, longitudinal neck 24 of housing 16 for connecting a hose, such as hose 14, to housing 16 and placing the hose in communication with cavity 18. Four apertures 26 are illustrated as being provided in the upper frusto-conical portion of housing 16 adjacent neck 24 for permitting a fluid, such as air, to escape from housing 16 subsequent to being ejected into cavity 18 at neck 24. A baffle 28 is arranged within housing 16 for directing the flow of fluid through housing 16 along a predetermined optimum path.

Baffle 28 is arranged within housing 16 above cavity 18, with the lower surface of baffle 28 partially defining cavity 18. Neck 24, at an upper surface thereof adjacent flange 22, is provided with four openings 30, as illustrated, with baffle 28 including a like number of substantially parallel passages 32 arranged communicating with openings 30, one passage to one opening, and oriented extending substantially vertically downwardly toward cavity 18 and liquid reservoir 20. Baffle 28 also includes a plurality of bores 34 like in number to apertures 26 with which the bores 34 are associated, one bore to one aperture. Like the passages 32, the bores 34 are arranged substantially parallel to one another and to passages 32, and are oriented substantially vertically so as to extend from cavity 18 to apertures 26.

As perhaps can best be seen from FIG. 3, apertures 34 are provided in sloped surfaces 36 of the upper portion of housing 16 which forms a transition between the lower portion thereof which forms cavity 18 and the neck 24 which caps housing 16.

Fenders 38, only two of which are shown, but it being understood that more or less could be employed depending on the internal configuration of the interior of cavity 18, extend into the interior of cavity 18 above an upper level L of the water W, or other suitable liquid, disposed in reservoir 20, and are curved so as to present a concave surface facing the aperture 26 for directing fluid flow from the passages 32 across the upper level L of the liquid in reservoir 20 and to the bores 34 for discharge. Appropriate curvature of the fenders 38, which extend from the lowermost sections of the reinforced, opposed wall portions 40, which can be considered as forming part of baffle 28, will assure that the air flow downwardly from passages 32 will follow an appropriate curvature across the upper surface of the water W and flow efficiently up bores 34 and out of housing 16.

As can be readily understood from the above description and from the drawings, a lint interceptor according to the present invention provides optimum flow through the traps of the interceptor, thus virtually eliminating back pressure on the associated dryer. While materials used for constructing the invention can vary, any metal, synthetic resin, wood, and the like, may be employed to fabricate the device. Passages 32 will deliver the lint (not shown) to the level L of water W where the contour trap above level L, partially formed by fenders 38 and the curved lower surface 42 of baffle 28, will transfer the clean warm air to the exhaust bores 34 that are directed to the top of the unit just below the neck 24. In the downward thrust caused by the dryer's fan (not shown), the liquid in reservoir 20 becomes activated, and in doing so traps the passing lint, which thus remains suspended and drops to the bottom of reservoir 20.

The inner web-like construction of the passages 32 and bores 34, and the trap-like effect formed by baffle 28 in cooperation with cavity 18 prevents any possible escape of lint to the outer atmosphere, and the liquid contents of reservoir 20 need only be replenished when the level drops below, for example, one half inch of the bottom wall 44 of housing 16.

The internal baffle structure of the invention maintains free motion and releases any back pressures that may have some effect on the thermostats (not shown) that control the working temperature of the dryer, with the efficiency of the unit eliminating the possibility of any lint escaping to the atmosphere around the interceptor.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a lint interceptor, including, in combination:

(a) a housing having a frusto-conical top portion and a rectangular lower portion provided with a cavity forming a liquid reservoir, the top portion including a vertically extending, longitudinal neck including passage means for communicating with the cavity:

(b) fitting means provided on the neck of the top portion of the housing for connecting a hose to the housing and placing the hose in communication with the cavity; and (c) aperture means provided in the top portion of the housing for permitting the escape from the housing of a fluid ejected into the cavity at the fitting means;

(d) the improvement comprising baffle means arranged within the housing for directing the flow of the fluid through the housing along a desired path, the baffle means being arranged in the housing above the cavity provided in the housing, the baffle means including passage means disposed in communication with the fitting means, cavity, and aperture means for forming a flow path through the housing, the baffle means further including opposed wall portions extending from the top portion to the lower portion, and opposed curved fender means arranged beneath the passage means and attached to the wall portions and extending a relatively short distance into the cavity from the wall portions and disposed above an upper level of the liquid reservoir for directing fluid flow from the passage means across the upper level of the liquid reservoir and to the aperture means, the fitting means including a plurality of openings, and the passage means including a like number of substantially parallel passages communicating with the openings, one-to-one, the aperture means including a plurality of apertures, and the passage means further including a like number of substantially parallel bores communicating with the apertures, one-to-one, the passages and bores being arranged substantially parallel to one another, the baffle means comprising a body member in which the apertures and bores are provided and on which a curved surface is defined.

* * * * *